US005685893A

United States Patent [19]

Field et al.

[11] Patent Number: 5,685,893

[45] Date of Patent: Nov. 11, 1997

[54] ORE PELLETIZATION

[75] Inventors: John R. Field; Anthony P. Allen, both of West Yorkshire, England

[73] Assignee: Allied Colloids Limited, West Yorkshire, England

[21] Appl. No.: 540,166

[22] Filed: Oct. 6, 1995

Related U.S. Application Data

[63] Continuation-in-part of Ser. No. 190,114, filed as PCT/GB92/01432, Aug. 3, 1992, abandoned.

[30] Foreign Application Priority Data

Aug. 2, 1991 [GB] United Kingdom ..... 9116698

[51] Int. Cl.[6] ..... C22H 1/244

[52] U.S. Cl. ..... 75/772; 75/321; 75/324

[58] Field of Search ..... 75/772, 321, 324

[56] References Cited

U.S. PATENT DOCUMENTS

| | | | |
|---|---|---|---|
| 3,893,847 | 7/1975 | Derrick . | |
| 5,000,783 | 3/1991 | Dingeman | 75/767 |

FOREIGN PATENT DOCUMENTS

| | | |
|---|---|---|
| 0225171 | 11/1986 | European Pat. Off. . |
| 0288150 | 3/1988 | European Pat. Off. . |
| 0376713 | 7/1990 | European Pat. Off. . |
| 0413603 | 2/1991 | European Pat. Off. . |
| 413603 | 3/1991 | European Pat. Off. . |

OTHER PUBLICATIONS

Mining Engineers 1978 (NY) 30(1), p. 53, Clum et al.

*Primary Examiner*—Melvyn Andrews
*Attorney, Agent, or Firm*—Sughrue,Mion,Zinn,Macpeak & Seas, PLLC

[57] ABSTRACT

In an iron ore pelletization process in which particulate ore is mixed with particulate polymeric binder in the presence of moisture and the mixture is pelletised, the particulate binder is a blend of ionic synthetic water soluble polymer, such as a copolymer of acrylamide and sodium acrylate having intrinsic viscosity 2 to 16 dl/g, with a larger amount of a guar gum.

8 Claims, No Drawings

ORE PELLETIZATION

RELATED APPLICATION

This application is a continuation in part of Ser. No. 08/190,114 filed 2 Feb. 1994 now abandoned by John Rodney Field and Anthony Peter Allen under 35 U.S.C. 371 from PCT/GB92/01432 of 3 Aug. 1992.

FIELD OF THE INVENTION

This invention relates to ore pelletisation processes which comprise forming an intimate mixture of particulate ore and particulate binder in the presence of moisture, forming green pellets by agitation of the mixture (for instance by rolling or tumbling) and firing the green pellets to produce ore pellets.

Bentonite has been a widely used particulate binder but numerous proposals have been made to use synthetic or natural organic polymers.

One class of natural polymers that has been used are various soluble starches. Another class are soluble cellulose derivatives which are usually esters (especially carboxymethyl cellulose) or ethers (especially hydroxyethyl cellulose). Another class are soluble gums such as xanthan gum or guar gum. It has been proposed to use mixtures of binder clay (bentonite) with the polymers. For instance Clum et al in Mining Engineers 1978 (NY) 30(1), page 53 show the results obtained using binders comprising guar gum, hydroxyethyl cellulose, polyoxyethylene oxide, and also bentonite.

There have been numerous proposals to use various soluble particulate synthetic polymers. Thus the particulate binder may comprise synthetic polymer particles often having a size up to 300 μm formed by polymerisation of water soluble, ionic, ethylenically unsaturated monomer or monomer blend to form water soluble polymer particles. The monomer blend is free of cross linking agent, so as to avoid cross linking with the consequential risk of insolubility.

For example we describe in EP-A-225171 the use, as particulate binder, of water soluble synthetic polymer that has intrinsic viscosity 3 to 16 dl/g and that is an anionic polymer and we describe in EP 0288150 the use of cationic polymers.

The use as pelletisation binder of soluble anionic synthetic polymer has several advantages over the use of bentonite, but it can suffer from one disadvantage in that it is difficult to achieve adequate dry strength in the ore pellets at economic dosages. Even if the dosage is increased in order to improve dry strength, there may then be other disadvantages, such as stickiness and aggregation of pellets in the drum and instability during the pelletising process.

Similarly, the use of natural polymers alone has not proved entirely satisfactory since they may not lead to the optimum combination of green strength, dry strength and drop number.

One attempt at improving one natural polymer (starch) is described in Dingeman U.S. Pat. No. 5,000,783. In this a binder is used which always consists of a large amount of starch to which has been added a minor amount of a modifying component. Amongst the modifying components that are mentioned are synthetic anionic polymers, guar gum, and numerous other materials. In one example a binder consists of 85% starch, 14% guar gum and 1% polyacrylic acid. The dominant material in this binder will be the starch.

OBJECTS OF THE INVENTION

One object of the invention is to provide an improved ore pelletisation process. Another object of the invention is to improve the binding performance of particulate ionic synthetic water soluble polymer in an ore pelletisation process. Another object of the invention is to provide improved organic binders for use in ore pelletisation processes.

SUMMARY OF THE INVENTION

In an ore pelletisation process according to the invention, particulate ore is mixed with particulate organic binder in the presence of moisture and the mixture is pelletised, and the particulate organic binder is provided as a blend of 1 part ionic synthetic water soluble polymer with from 2 to 30 parts of a soluble natural polymer which is guar gum.

Throughout this specification, parts are parts by weight.

DESCRIPTION OF THE PREFERRED EMBODIMENTS

The gum may have been treated in known manner to increase its solubility, for instance it may be a phosphated guar gum.

The guar gum interacts with the moisture and the ionic synthetic polymer to give improved bonding performance or, expressed alternatively, the synthetic polymer interacts with the moisture and the guar gum to provide improved bonding performance. There is competition between the ionic polymer and the guar gum for moisture from the pelletisation mixture. As is well known, the amount of moisture in the pelletisation process must be strictly limited and it is therefore essential that there should not be significant amounts of other natural organic polymer in the particulate mixture to create significant additional competition for moisture between the guar gum and the ionic synthetic water soluble polymer. Accordingly, the natural polymer in the binder, and which is present during the pelletisation process, usually consists only of the guar gum.

If any other natural polymer is present in the binder or during the pelletisation process, its amount must be so small that it will not compete significantly with the guar gum and the ionic synthetic water soluble polymer. Thus any additional natural organic polymer must be present in the binder and during the process in such a small amount as to have no significant effect on the pelletisation performance. In practice this means that there will usually be no other natural polymer in the particulate binder or during the process but that if there is any other natural organic polymer then its amount should be significantly less than the amount of guar gum, for instance less than one-tenth of the amount of the guar gum. Usually the guar gum provides at least 70%, and usually at least 90% by weight of the binder that is added into the pelletisation process and of the binding components present during the process. Preferably the guar gum is the only natural polymer which is used.

Usually the ionic synthetic water soluble polymer is the only synthetic polymer which is used in the binder.

The amount of soluble synthetic polymer is generally at least 0.005% and usually at least 0.01% (by weight of the total mix) but the amount is generally not more than 0.1% and is frequently less, for instance below 0.06%. Amounts of 0.01 to 0.04% are often suitable.

The total amount of water soluble synthetic polymer and water soluble guar gum used in the invention is usually at least 0.03% and often at least 0.05%. It is generally undesirable for it to be more than 0.3% and it is usually below 0.2%. Amounts of 0.05 to 0.1 or 0.15% are often suitable.

The amount of the guar gum is usually at least 0.02% and generally at least 0.04%. Although the amount can be, for instance, 0.2% or even more it is preferably below 0.15% and generally below 0.1%. It is very surprising that these low amounts of guar gum give a beneficial effect, since it is usually necessary to use relatively large amounts, typically 0.4% or more, to obtain beneficial binding results when using guar gum or other natural polymer.

The amount of the guar gum is generally (per part by weight of the soluble synthetic polymer) at least 3 parts and frequently at least 5 or 6 parts. It is normally below 15 parts, and is generally below 10 parts.

The binder may include other binding additives which are not water soluble synthetic polymer or natural polymer. Thus it may include inorganic material. For instance the organic binder of soluble organic polymer and guar gum can be used in combination with bentonite.

It is particularly preferred that the binder should also includes sodium carbonate or other water soluble monomeric additive of the type described in EP 225171. The amount of this is generally from 0.2 to 2 parts, often around 0.7 to 1.5 parts, per part by weight of the synthetic polymer.

Preferred binders consist of 1 part by weight soluble synthetic polymer, 0.7 to 1.3 parts by weight sodium carbonate and 2 to 12 parts by weight guar gum.

The components of the binder may be premixed or they may be supplied to the pelletising process separately but preferably substantially simultaneously.

The total amount of binder (water soluble synthetic polymer plus guar gum plus sodium carbonate or other salt) is typically in the range 0.03 to 0.3%, often around 0.05 to 0.2%. Bentonite may be used with this binder.

The polymer can be cationic, for instance as described in EP 0288150, but is generally anionic as in EP 225171. The amount by weight of sodium acrylate or other anionic monomer is generally in the range 5 to 90% by weight, with the balance preferably being acrylamide. It is normally preferred for the polymer to be a copolymer of acrylamide with 10 to 40%, often 15 to 30%, sodium acrylate.

However it can be desirable to use larger amounts of sodium acrylate, e.g., 50 to 80%, typically around 70%. Intrinsic viscosity can be in the range 2 or 3 to 16 dl/g, often in the range 5 to 9 or 12 dl/g, but in some instances can be higher, for instance up to 25 dl/g.

It is generally desired that the soluble synthetic polymer should be wholly linear in which event it will normally have been polymerised in the absence of any added cross linking agent. However it can be advantageous for the synthetic polymer to be a water soluble, partly cross linked polymer. The amount of cross linking agent should be selected so that it is insufficient to render the polymer particles predominantly water insoluble but sufficient to give a useful benefit, particularly an increase in the dry strength of the ore pellets, provided that the amount is such that the particles still behave predominantly as water soluble polymer particles, for instance as regards their film-forming and rheological characteristics. The amount of cross linking agent typically is 5 to 50 ppm, preferably 7 to 20 ppm when the IV is 2 to 7 dl/g and 2 to 30 ppm, preferably 5 to 15 ppm, when IV is 7 to 16 dl/g. These IV's are measured on the polymer in the absence of cross linking agent and the amounts of cross linking agent are calculated as methylene bis acrylamide. Different, generally larger, amounts will be required to obtain the same rheology and solubility characteristics using other cross linkers. Generally the amount of cross linking agent is below 18 ppm, measured as methylene bis acrylamide.

In this specification, IV values are determined by conventional single point IV measurement in dl/g at 20° C.

Some or all of the components of the particulate binder used in the invention can be supplied as a dispersion of particles in oil, but it is generally preferred for them to be supplied as a dry powdered particulate composition. The particles may be aggregates, for instance as described in EP 0326382. The size of the binder particles is normally below 300 μm, generally below 200 μm and preferably below 150 μm, but is generally above 20 μm.

The particulate ore is preferably an iron ore but can be any other mineral ore that is capable of being pelletised, for instance a zinc ore. The materials and process conditions can be broadly as described in EP 225171, except that the binder must include the defined large amount of guar gum. Bentonite can be used as part of the binder.

In Examples 1 and 2 below, pelletisation processes were conducted as in the examples of EP 225171 using various combinations of guar gum and anionic polymer formed as in EP 225171. The results were as follows.

EXAMPLE 1

| | |
|---|---|
| Product A - | a 20% anionic polyacrylamide blended 50/50 with sodium carbonate |
| Product B - | a guar gum |
| Product C - | a 2/7 active polymer blend of A and B |

| | Green Strength/Kg | Dry Strength/Kg | Drop Number | % Moisture |
|---|---|---|---|---|
| 0.09% C | 1.00 | 2.80 | 29.3 | 10.3 |
| 0.10% B | 1.31 | 2.26 | 37.0 | 9.7 |

EXAMPLE 2

Product D - a 1/5 active polymer blend of A and B

| | Green Strength/Kg | Dry Strength/Kg | Drop Number | % Moisture |
|---|---|---|---|---|
| 0.12% D | 1.18 | 8.15 | 21.3 | 10.5 |
| 0.12% B | 1.30 | 6.08 | 45.0 | 10.0 |

A combination of an anionic polyacrylamide blend with sodium carbonate and guar gum gives acceptable green properties whilst increasing the dry strength over that obtained with guar gum on its own.

In the two examples described, the dry strength has been increased by 24.0 and 34.0% respectively as a result of blending the guar gum with the synthetic polymer. Thus, even though dry strength tends to be a problem with binders based on synthetic polymer, the addition of the synthetic polymer to the guar gum increases the dry strength attainable using a similar amount of the natural polymer in the absence of the synthetic polymer.

We claim:

1. An ore pelletization process comprising providing particulate ionic synthetic water soluble polymer, providing particulate soluble natural polymer which consists essentially of guar gum, forming a mixture of particulate ore, moisture and binder by mixing particulate ore in the presence of moisture with a binding amount of particulate organic binder which consists essentially of 1 part by weight of the ionic synthetic water soluble polymer and 2 to 30 parts by weight of the water soluble natural polymer which consists essentially of guar gum, and pelletizing the mixture of particulate ore, moisture and binder.

2. A process according to claim 1 in which the particulate ore is mixed with particulate organic binder which consists of the ionic synthetic water soluble polymer and the water soluble guar gum.

3. A process according to claim 1 in which the ionic polymer is an ionic synthetic water soluble polymer formed of a blend of 10 to 90% acrylamide and 90 to 10% sodium acrylate and has an intrinsic viscosity of 2 to 16 dl/g.

4. A process according to claim 1 in which the ionic synthetic polymer formed of a blend 60 to 90% by weight acrylamide and 40 to 10% by weight sodium acrylate and has intrinsic viscosity of 5 to 9 dl/g.

5. A process according to claim 1 in which the amount of the guar gum is 3 to 10 parts by weight per part by weight of the ionic synthetic polymer.

6. A process according to claim 1 in which the amount of the synthetic ionic polymer is 0.005 to 0.1% and the amount of the guar gum is from 0.05 to 0.2% by weight of the total mixture.

7. A process according to claim 1 in which the ore is iron ore in the form of particles mainly below 250 mm.

8. A process according to claim 1 in which the guar gum is at least 70% by weight of the total amount of natural organic polymer which is present in the mixture of ore, moisture and binder.

* * * * *

UNITED STATES PATENT AND TRADEMARK OFFICE

CERTIFICATE OF CORRECTION

PATENT NO. : 5,685,893

DATED : November 11, 1997

INVENTOR(S) : John R. Field et al.

It is certified that error appears in the above-identified patent and that said Letters Patent is hereby corrected as shown below:

In column 6, the second line of Claim 7 should read:

-- ore in the form of particles mainly below 250 μm. --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*